US010665983B2

(12) United States Patent
Fair et al.

(10) Patent No.: US 10,665,983 B2
(45) Date of Patent: May 26, 2020

(54) POTTING BOOT AND IN-LINE ELECTRICAL CONNECTOR ASSEMBLY INCLUDING THE SAME

(71) Applicant: Eaton Intelligent Power Limited, Dublin (IE)

(72) Inventors: James Douglas Fair, Fayetteville, GA (US); Kent Brownell Hambly, Simi Valley, CA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/461,874

(22) PCT Filed: Nov. 17, 2017

(86) PCT No.: PCT/US2017/062324
§ 371 (c)(1),
(2) Date: May 17, 2019

(87) PCT Pub. No.: WO2018/094223
PCT Pub. Date: May 24, 2018

(65) Prior Publication Data

US 2019/0356081 A1 Nov. 21, 2019

Related U.S. Application Data

(60) Provisional application No. 62/423,568, filed on Nov. 17, 2016.

(51) Int. Cl.

| | |
|---|---|
| ***H01R 13/523*** | (2006.01) |
| ***H01R 13/52*** | (2006.01) |
| ***H01R 13/512*** | (2006.01) |

(52) U.S. Cl.
CPC ..... *H01R 13/523* (2013.01); *H01R 13/512* (2013.01); *H01R 13/5205* (2013.01); *H01R 13/5216* (2013.01)

(58) Field of Classification Search
CPC ..... H01R 13/512; H01R 13/523; H01R 13/5205; H01R 13/5216
See application file for complete search history.

(56) References Cited

U.S. PATENT DOCUMENTS 3,750,084 A 7/1973 Gardner
4,090,759 A 5/1978 Herrmann, Jr.
(Continued)

OTHER PUBLICATIONS

International Search Report and Written Opinion for PCT/US2017/062324, dated Feb. 6, 2018, 12 pages, United States.

*Primary Examiner* — Briggitte R. Hammond
(74) *Attorney, Agent, or Firm* — Stinson LLP

(57) ABSTRACT

An in-line electrical connector includes a potting boot. The potting boot includes longitudinal ribs are spaced apart from one another about a longitudinal axis of a boot body. Internal thread members project radially inward from an interior surface of the boot body relative to the longitudinal axis. The thread members have arcuate lengths extending about the longitudinal axis of the boot body. Each longitudinal rib has an associated one of the internal thread members that radially overlaps an entirety of the width of the longitudinal rib relative to the longitudinal axis of the boot body. An electrical connector threadably mates to the internal thread members of the potting boot. The electrical connector electrically couples to another electrical connector.

20 Claims, 5 Drawing Sheets

(56) References Cited

U.S. PATENT DOCUMENTS

| | | | | |
|---|---|---|---|---|
| 6,162,082 | A * | 12/2000 | Karsten | H01R 13/523<br>439/318 |
| 9,368,907 | B2 * | 6/2016 | Becker | H01R 13/5221 |
| 9,618,701 | B2 * | 4/2017 | Mooij | G02B 6/3891 |
| 9,806,451 | B2 * | 10/2017 | Ono | H01R 13/4364 |
| 10,050,367 | B1 * | 8/2018 | Frank | H01R 13/2435 |
| 2003/0224661 | A1 * | 12/2003 | Dye | H01R 13/5221<br>439/606 |
| 2005/0250365 | A1 | 11/2005 | Starke et al. | |

* cited by examiner

POTTING BOOT AND IN-LINE ELECTRICAL CONNECTOR ASSEMBLY INCLUDING THE SAME

FIELD OF THE DISCLOSURE

The present disclosure generally relates to a potting boot and an in-line electrical connector including the same.

BACKGROUND OF THE DISCLOSURE

A variety of electrical connector designs are available for use in electrically connecting components, for example sensors with transmitters. Depending upon the particular application, a user selects the appropriate connector based on any number of application-specific factors, for example, code requirements, exposure to specific environmental conditions and anticipated lifespan, to name a few.

An especially challenging environment for using electrical connectors is with water meters and transmitters that are located in below ground water pits. Due to the nature of the application, electrical connectors used within water pits must be capable of resisting long term exposure to an environment ranging from high humidity to full submersion. In addition, the constraints associated with accessing and working within a water pit requires that the electrical connector be easy to assemble and install.

SUMMARY OF THE DISCLOSURE

An in-line electrical connector generally comprises a potting boot and an electrical connector. The potting boot includes a boot body having open proximal and distal end portions, a longitudinal axis extending through the proximal and distal end portions, and interior and exterior surfaces. An internal cavity is defined by the interior surface of the boot body and extends longitudinally within the boot body. Longitudinal ribs project radially outward from the exterior surface of the boot body relative to the longitudinal axis. Each longitudinal rib has a length extending lengthwise along the boot body and a width extending about the longitudinal axis of the boot body. The longitudinal ribs are spaced apart from one another about the longitudinal axis of the boot body. Internal thread members project radially inward from the interior surface of the boot body relative to the longitudinal axis. The thread members have arcuate lengths extending about the longitudinal axis of the boot body. Each longitudinal rib has an associated one of the internal thread members that radially overlaps an entirety of the width of the longitudinal rib relative to the longitudinal axis of the boot body. The electrical connector is threadably mated to the internal thread members of the potting boot. The electrical connector is configured to electrically couple to another electrical connector.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DISCLOSURE

Figure 1:
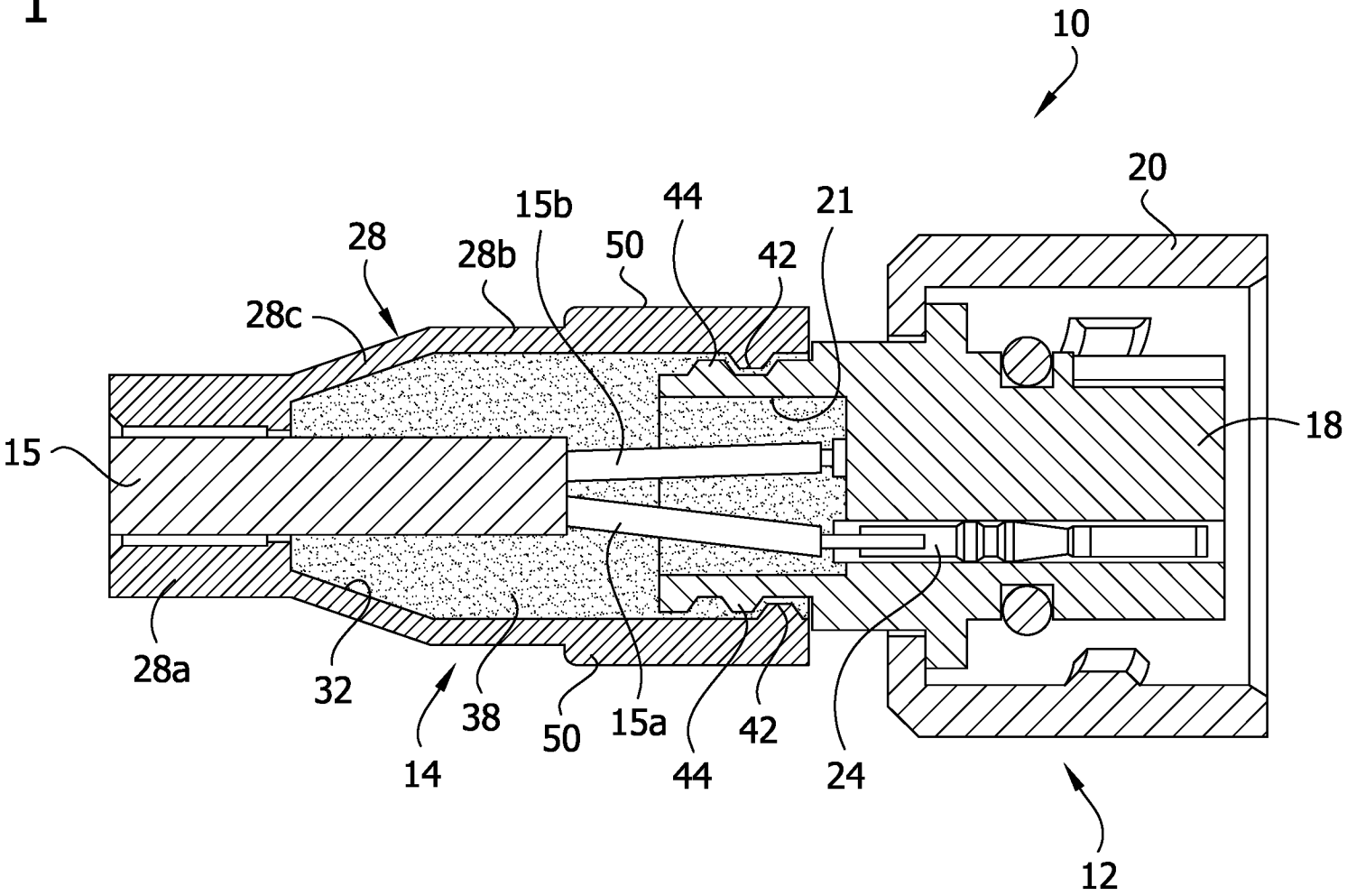
FIG. 1 is a longitudinal section of an in-line electrical connector assembly constructed according to the principles of the present disclosure.
Figure 2:
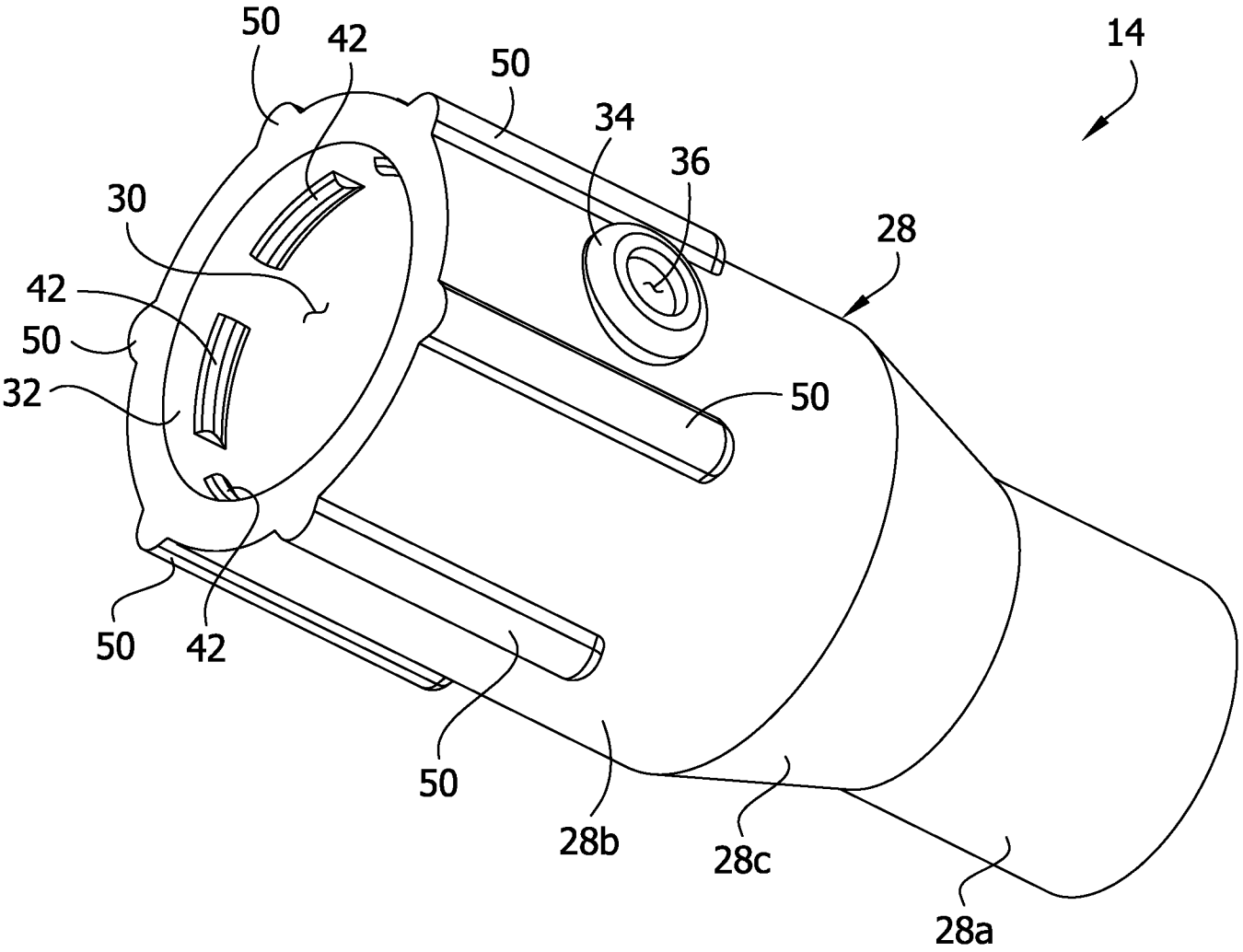
FIG. 2 is a perspective of a potting boot of the electrical connector assembly.
Figure 3:
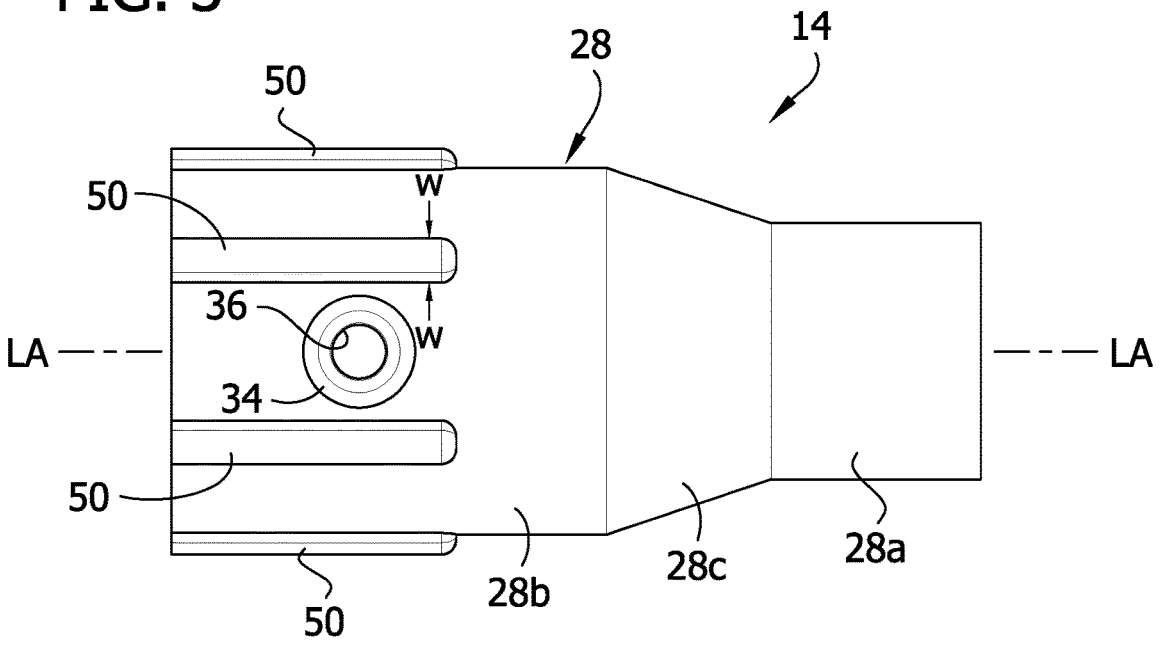
FIG. 3 is a side elevation of the potting boot.

Referring to FIG. 1 of the drawings, an in-line electrical connector assembly for mating connection with another electrical connector assembly is generally indicated at reference numeral 10. The illustrated electrical connector assembly 10 includes a connector (e.g., a plug connector), generally indicated at 12; a potting boot, generally indicated at reference numeral 14, threadably secured to the plug connector; and a cable 15 passing through the potting boot and electrically connected to the plug connector. In general, the illustrated plug connector 12 may be a conventional plug connector, such as a plug connector described in U.S. Pat. No. 7,033,193, filed Dec. 8, 2004, the entirety of which is incorporated by reference herein. The plug connector 12 includes a plug connector body 18 and a coupling nut 20 rotatably secured to the plug connector body. Wires 15*a*, 15*b* (only two of three wires are illustrated) of the cable 15 extend into a cavity 21 defined by a proximal end portion of the connector body 18 and are electrically coupled to contacts 24 (only one shown in FIG. 1) of the plug connector body 18. The plug connector 12 is configured to mate with a receptacle member (not shown) of a second electrical connector assembly to electrically couple the cable 15 of the illustrated electrical connector assembly with a second cable (not shown) of the second electrical connector assembly, as is generally known in the art. In particular, the plug connector body 18 is insertable into a receptacle connector body and the coupling nut 20 is threaded on a threaded projection of the receptacle connector body. It is understood that the plug connector may be of other designs or of other connector types without departing from the scope of the present disclosure. For example, the plug connector may be replaced with a receptacle connector or a different type of connector.

The design and construction of the potting boot 14 is non-conventional. The potting boot 14 includes a generally cylindrical boot body, generally indicated at reference numeral 28. The boot body 28 has open proximal and distal end portions 28*a*, 28*b*, respectively, and a longitudinal axis LA extending through the proximal and distal end portions. An interior surface 32 of the boot body 28 defines an internal cavity 30 extending axially along the longitudinal axis LA of the boot body. The inner and outer cross-sectional dimensions (e.g., diameters) of the distal end portion 28*b* are greater than those of the proximal end portion 28*a*. A longitudinal transition portion 28*c* disposed longitudinally between and interconnecting the proximal and distal end portions 28*a*, 28*b*, respectively, has inner and outer cross-sectional dimensions (e.g., diameters) that taper from the distal end portion to the proximal end portion.

A potting gate or port 34 on the distal end portion 28*b* defines a transverse passage 36 in communication with the internal cavity 30. The potting port 34 is configured to receive a delivery device for delivering potting material 38 into the internal cavity 30 after mating the potting boot 14 and the plug connector 12. In one example, the potting material 38 is liquid polyurethane 38 that encapsulates the wires/cables 15, 15*a*, 15*b* in the potting boot 14 to provide waterproofing or water-resistance after the potting material has hardened. The potting material 38 may be other materials other than polyurethane.

Internal thread members 42 are disposed on the interior surface 32 of the distal end portion 28*b* of the boot body 28 and extend generally radially inward from the interior surface 32 toward the longitudinal axis LA. The thread members 42 have arcuate lengths extending about the longitudinal axis LA of the boot body 28 and define a non-continuous helical thread that is configured to threadably mate with an external thread(s) 44 at the proximal end of the plug body 18 of the plug connector 12, as shown in FIG. 1. Longitudinal ribs 50 project radially outward from an exterior surface of the distal end portion 28*b* of the boot body 28 and have lengths extending longitudinally along the distal end portion. Each longitudinal rib 50 has a width W (FIG. 4) extending about the longitudinal axis LA of the boot body 28 between circumferential ends of the rib. The ribs 50 are spaced apart from one another circumferentially about the longitudinal axis LA of the boot body 28. The ribs 50 provide enhanced gripping when manually threading together the potting boot 14 and the plug connector 12. The ribs 50 also provide rigidity to the potting boot 14.

It has been discovered that a conventional design of the potting boot is susceptible to cracking in a longitudinal direction adjacent the ribs. To alleviate this potential cracking, the potting boot 14 of the present disclosure has improved the structure of the internal thread members 42 and the arrangement of the internal thread members relative to the ribs 50. It is understood that the potting boot may include one or both of these improvements in accordance with the present disclosure.

Figure 6:
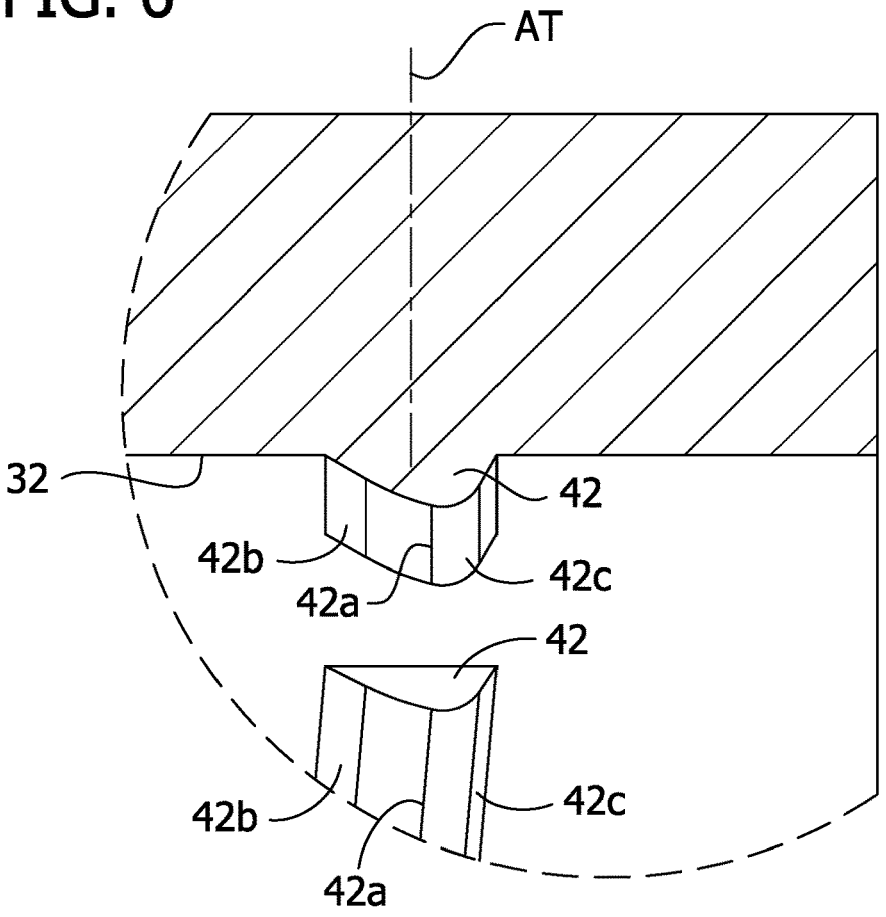
FIG. 6 is an enlarged view of the longitudinal section of FIG. 5.

Referring to FIG. 6, the structure of each of the internal thread members 42 alleviates potential weakening of the boot body 28 when the potting boot 14 (including the internal thread members) is formed by molding undercuts and then jump ejecting the molded boot from a die. In such a process, the molded potting boot is removed from the die by jumping the internal thread members over the threads of the die. It has been discovered, however, that jump ejection may plastically deform the internal threads, thereby causing tearing of and/or microvoids to form in the potting boot. To inhibit or reduce deformation of the internal thread members 42 during jump ejection of the molded boot 14 from the die, the internal thread members are molded to have improved cross-sectional dimensions (e.g., cross-sectional sizes and shapes), as shown in FIG. 6, for example. That is, the thread members 42 are molded to have the improved cross-sectional shape without deforming or before deformation of the thread members during jump ejection. It is believed these improved thread members 42 facilitate jump ejection of the boot 14 from the die while reducing deformation of the internal thread members to alleviate potential weakening of the boot body 28.

Referring still to FIG. 6, in the illustrated embodiment, each thread member 42 has a non-uniform cross-sectional shape along its arcuate length, and an apex 42*a* of the thread member is offset laterally from a longitudinal axis AT of the corresponding thread member. In this way, each thread member 42 has a first side surface 42*b* (e.g., a proximal-facing side surface) at a first side of the apex 42*a* with a cross-sectional slope that is less than a cross-sectional slope of a second side surface 42*c* (e.g., a distal-facing side surface) at a second side of the apex. In other words, the first side surface 42*b* slopes more gradually from the apex 42*a* toward the interior surface 32 compared to the second side surface 42*c*. In one example, the first side surface 42*b* may extend toward the apex 42*a* at an angle of about 30 degrees relative to the interior surface 32 of the boot body 28, and the second side surface 42*c* may extend toward the apex at an angle of about 60 degrees relative to the interior surface of the boot body. The height of the thread member 42 may measure about 0.0120 in (0.3048 mm) at its apex 42*a* from the interior surface 32 of the boot body 28. Each thread member 42 may have other dimensions without departing from the scope of the present disclosure.

Figure 4:
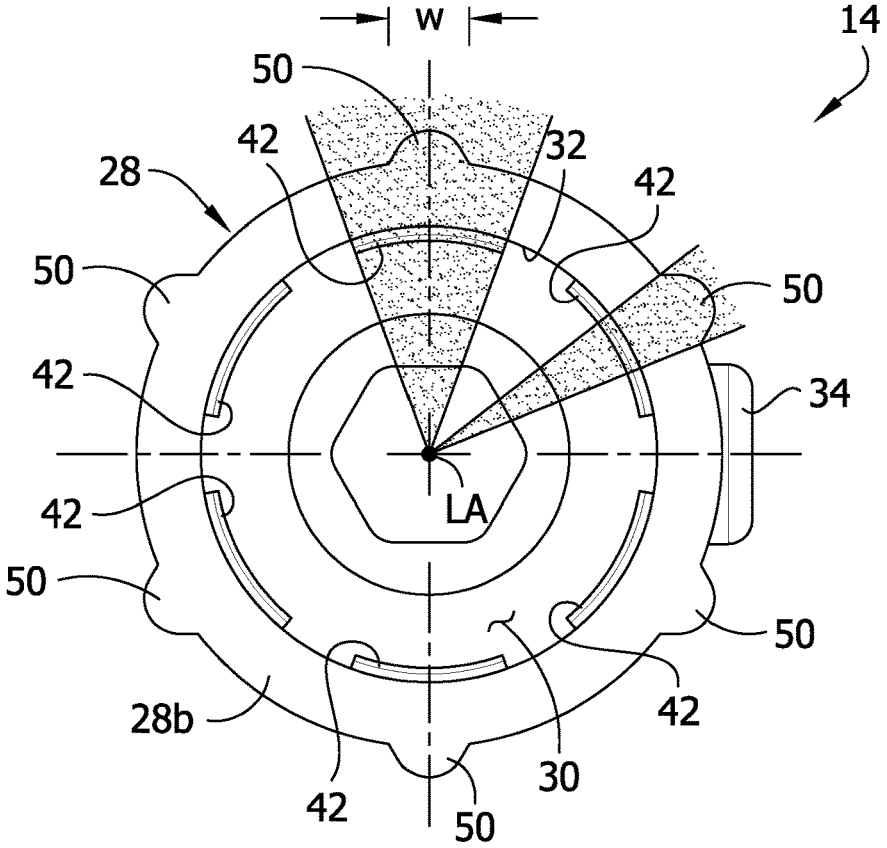
FIG. 4 is a distal end elevational view of the potting boot.
Figure 5:
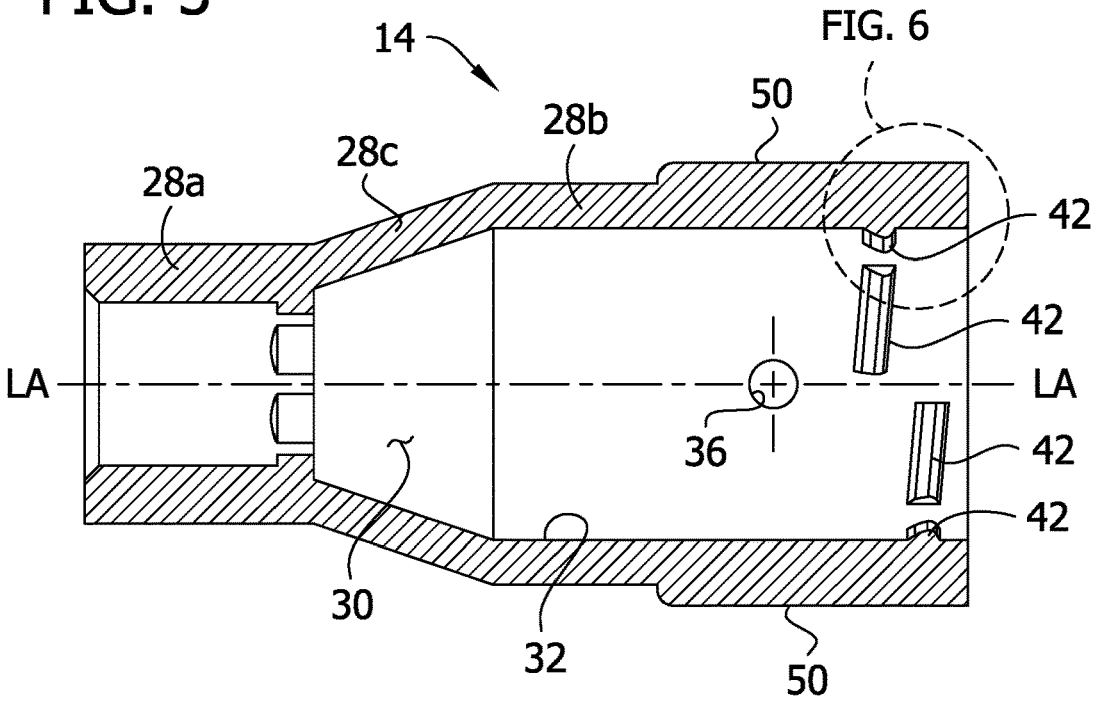
FIG. 5 is a longitudinal section of the potting boot.

Referring to FIG. 4, the thread members 42 are arranged relative to the ribs 50 to strengthen the boot body 28 at each of the ribs to thereby inhibit cracking and/or tearing of the potting boot 14. In the illustrated embodiment, each rib 50 has an associated internal thread member 42 that radially overlaps an entirety of the width W of the rib. This radial overlapping is illustrated by radial shading of an area encompassed between radial lines extending from the longitudinal axis LA through opposite longitudinal ends of one of the thread members 42. As can be seen, the width W of the associated rib 50 is entirely within the shaded area. In other words, each rib 50 has an internal thread member 42 associated therewith, such that an entirety of the width W of the rib is disposed radially between opposite first and second longitudinal ends of the corresponding thread member relative to the longitudinal axis LA of the boot body 28. Radial lines extending radially relative to the longitudinal axis LA of the boot body 28 and bisecting the widths W of the longitudinal ribs 50 also bisect the arcuate lengths of the associated internal thread members 42. As shown in FIG. 4, opposite longitudinal end portions of each of the thread members 42 extend circumferentially beyond the radial lines passing through circumferential ends of the associated rib 50. Each of the opposite longitudinal end portions of each thread member 42 extending circumferentially beyond the radial lines passing through circumferential ends of the associated rib 50 a percentage of the arcuate length of the thread member. For example, this percentage may be from about 1% to about 35%, or from about 10% to about 30%, or from about 15% to about 25%. In the illustrated embodiment, the number of thread members 42 equals the number of ribs 50. Each longitudinal rib 50 has one and only one associated internal thread member 42. Each internal thread member 42 has one and only one associated longitudinal rib 50. In other embodiments, there may be less or more thread members 42 than ribs 50.

Figure 7:
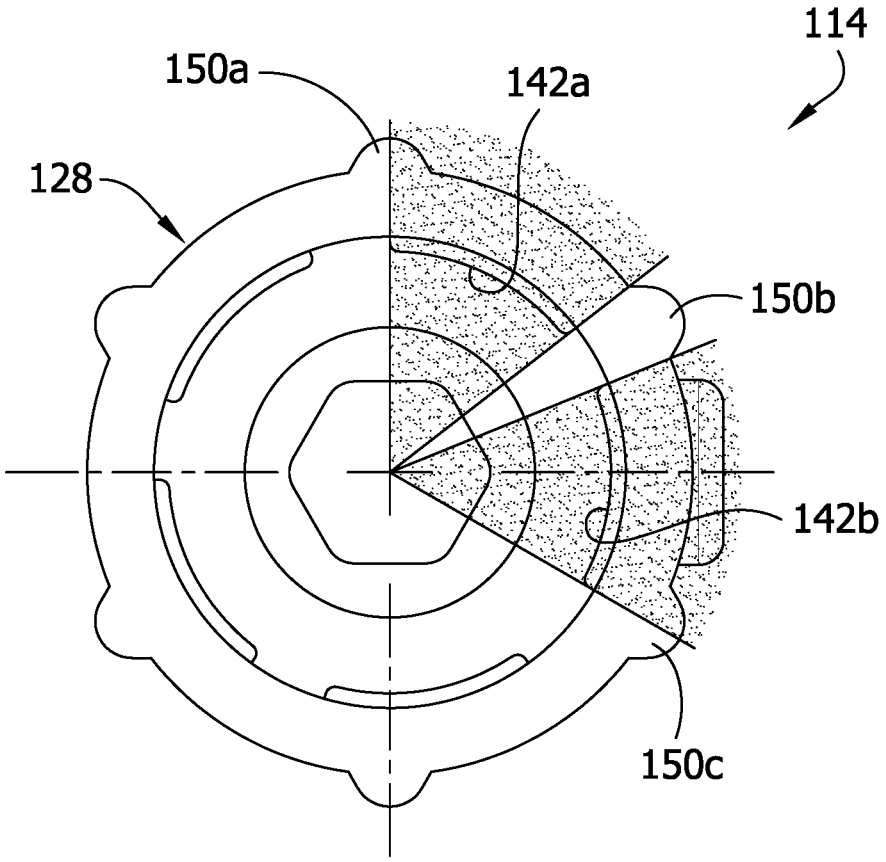
FIG. 7 PRIOR ART
FIG. 7 is a distal end elevational view of a conventional potting boot.

In a conventional potting boot, such as potting boot 114 in FIG. 7, an entirety of the width at least one rib is not disposed radially between arcuate longitudinal ends of an associated one of the internal thread members. As shown by shading in FIG. 7, entireties of the ribs marked 150*a*, 150*b*, 150*c* are not radially overlapped by corresponding thread members 142*a*, 142*b*. In particular, internal thread members 142*a*, 142*b* only partially radially overlap ribs 150*a*, 150*c*, and do not radially overlap any portion of rib 150*b*. As such, the boot body 128 may be weakened at the locations of the intersections of the ribs 150*a*, 150*b*, 150*c* and the boot body that are not radially overlapped by a thread member.

The potting boot 14 may be molded from a plastic, such as polypropylene, or may be formed in other ways. In one method of making the potting boot 14, the potting boot is a molded in a die that forms the thread members 42 to have the shape and dimensions as shown and described herein. In other words, the thread members 42 shown and described herein are formed by the die molding process, rather than being deformed into the shape when ejecting the potting boot 14 from the die. As described above, this facilitates removal of the potting boot 14 from the die while minimizing tearing or weakening of the potting boot when removing the potting boot.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An in-line electrical connector comprising:

a potting boot including a boot body having open proximal and distal end portions, a longitudinal axis extending through the proximal and distal end portions, and interior and exterior surfaces, an internal cavity defined by the interior surface of the boot body and extending longitudinally within the boot body, longitudinal ribs projecting radially outward from the exterior surface of the boot body relative to the longitudinal axis, each longitudinal rib have a length extending lengthwise along the boot body and a width extending about the longitudinal axis of the boot body, wherein the longitudinal ribs are spaced apart from one another about the longitudinal axis of the boot body, and internal thread members projecting radially inward from the interior surface of the boot body relative to the longitudinal axis, wherein the thread members have arcuate lengths extending about the longitudinal axis of the boot body, wherein each longitudinal rib has an associated one of the internal thread members that radially overlaps an entirety of the width of the longitudinal rib relative to the longitudinal axis of the boot body; and an electrical connector threadably mated to the internal thread members of the potting boot, wherein the electrical connector is configured to electrically couple to another electrical connector.

2. The in-line electrical connector set forth in claim 1, wherein opposite longitudinal end portions of each of the internal thread members extend circumferentially beyond radial lines passing through circumferential ends of the associated rib relative to the longitudinal axis of the boot body.

3. The in-line electrical connector set forth in claim 2, wherein the longitudinal end portions of each of the internal thread members extending circumferentially beyond radial lines passing through circumferential ends of the associated rib relative to the longitudinal axis of the boot body have arcuate lengths that are from about 1% to about 35% of the arcuate length of the internal thread member.

4. The in-line electrical connector set forth in claim 2, wherein the longitudinal end portions of each of the internal thread members extending circumferentially beyond radial lines passing through circumferential ends of the associated rib relative to the longitudinal axis of the boot body have arcuate lengths that are from about 10% to about 30% of the arcuate length of the internal thread member.

5. The in-line electrical connector set forth in claim 2, wherein the longitudinal end portions of each of the internal thread members extending circumferentially beyond radial lines passing through circumferential ends of the associated rib relative to the longitudinal axis of the boot body have arcuate lengths that are from about 15% to about 25% of the arcuate length of the internal thread member.

6. The in-line electrical connector set forth in claim 1, wherein radial lines extending radially relative to the longitudinal axis of the boot body and bisecting the widths of the longitudinal ribs also bisect the arcuate lengths of the associated internal thread members.

7. The in-line electrical connector set forth in claim 6, wherein each longitudinal rib has one and only one associated internal thread member.

8. The in-line electrical connector set forth in claim 7, wherein each internal thread member has one and only one associated longitudinal rib.

9. The in-line electrical connector set forth in claim 1, wherein the longitudinal rib and the internal thread members are at the distal end portion of the boot body.

10. The in-line electrical connector set forth in claim 1, wherein the potting boot further includes a potting inlet extending outward from the boot body, wherein the potting inlet is configured to deliver potting material to the internal cavity.

11. The in-line electrical connector set forth in claim 10, wherein the potting inlet defines a transverse passage in fluid communication with the internal cavity.

12. The in-line electrical connector set forth in claim 11, further comprising a cable extending longitudinally within the internal cavity, wherein the cable is electrically coupled to the electrical connector.

13. The in-line electrical connector set forth in claim 12, wherein the electrical connector includes a proximal end portion defining a cavity therein, wherein the cable is electrically coupled to the electrical connector within the cavity of the electrical connector.

14. The in-line electrical connector set forth in claim 13, further comprising potting material received in the internal cavity and the cavity of the electrical connector, wherein the potting material encapsulates the cable.

15. The in-line electrical connector set forth in claim 12, further comprising potting material received in the cavity of the electrical connector, wherein the potting material encapsulates the cable.

16. The in-line electrical connector set forth in claim 15, wherein the potting material comprises polyurethane.

17. The in-line electrical connector set forth in claim 16, wherein the electrical connector comprises a plug connector.

18. The in-line electrical connector set forth in claim 17, wherein the plug connector comprises a plug body and a nut rotatably secured to the plug body.

19. The in-line electrical connector set forth in claim 1, wherein each of the internal thread segments has a non-uniform cross-sectional shape along its length, and an apex of the internal thread member is offset laterally from a longitudinal axis of the internal thread member.

20. The in-line electrical connector set forth in claim 19, wherein each internal thread member has a first side surface at a first side of the apex with a cross-sectional slope that is less than a cross-sectional slope of a second side surface at a second side of the apex.

* * * * *